US010883498B2

(12) United States Patent
Dalmas, II et al.

(10) Patent No.: US 10,883,498 B2
(45) Date of Patent: Jan. 5, 2021

(54) VARIABLE VOLUME CHAMBER FOR INTERACTION WITH A FLUID

(71) Applicant: Quest Engines, LLC, Coopersburg, PA (US)

(72) Inventors: Elario Dino Dalmas, II, Macungie, PA (US); Roy Albert Blom, Coopersburg, PA (US); Brett J. Leathers, Allentown, PA (US)

(73) Assignee: QUEST ENGINES, LLC

( * ) Notice: Subject to any disclaimer, the term of this patent is extended or adjusted under 35 U.S.C. 154(b) by 303 days.

(21) Appl. No.: 15/970,206

(22) Filed: May 3, 2018

(65) Prior Publication Data

US 2018/0320688 A1 Nov. 8, 2018

Related U.S. Application Data

(63) Continuation-in-part of application No. 15/965,009, filed on Apr. 27, 2018, now Pat. No. 10,724,428.

(60) Provisional application No. 62/501,318, filed on May 4, 2017.

(51) Int. Cl.

| | |
|---|---|
| ***F01C 21/10*** | (2006.01) |
| ***F04C 9/00*** | (2006.01) |
| ***F04C 2/077*** | (2006.01) |
| ***F04C 15/00*** | (2006.01) |
| ***F04C 28/08*** | (2006.01) |
| ***F01C 1/067*** | (2006.01) |
| ***F01C 1/063*** | (2006.01) |
| *F02B 33/36* | (2006.01) |

(52) U.S. Cl.

CPC ..... *F04C 9/002* (2013.01); *F04C 2/077* (2013.01); *F04C 15/0061* (2013.01); *F04C 28/08* (2013.01); *F02B 33/36* (2013.01); *F04C 2240/20* (2013.01); *F04C 2250/20* (2013.01)

(58) Field of Classification Search

CPC ..... F04C 9/002; F04C 2/077; F04C 15/0061; F04C 28/08; F01C 1/067; F01C 1/063; F01C 21/10; F16H 25/16

See application file for complete search history.

(56) References Cited

U.S. PATENT DOCUMENTS

| | | | |
|---|---|---|---|
| 1,016,561 | A | 2/1912 | Grabler |
| 1,046,359 | A | 12/1912 | Winton |
| 1,329,559 | A | 2/1920 | Tesla |
| 1,418,838 | A | 6/1922 | Selz |

(Continued)

FOREIGN PATENT DOCUMENTS

| | | |
|---|---|---|
| CN | 201526371 | 7/2010 |
| CN | 106321916 | 1/2017 |

(Continued)

OTHER PUBLICATIONS

English translation of FR 944904 by Espacenet, Apr. 6, 2020.*

(Continued)

*Primary Examiner* — Deming Wan

(74) *Attorney, Agent, or Firm* — Yohannan Law; David R Yohannan

(57) ABSTRACT

Variable volume chamber devices are disclosed. The chambers may be defined by the space between two complementary rotors. The volume of the chambers may vary as a function of the variation of relative rotational speeds of the two rotors.

21 Claims, 4 Drawing Sheets

(56) References Cited

U.S. PATENT DOCUMENTS 1,511,338 A 10/1924 Cyril
1,527,166 A 2/1925 Maurice
1,639,308 A 8/1927 Orr
1,869,178 A 7/1932 Thuras
1,967,682 A 7/1934 Ochtman, Jr.
1,969,704 A 8/1934 D'Alton
2,025,297 A 12/1935 Meyers
2,224,475 A 12/1940 Evans
2,252,914 A 8/1941 Balton
2,283,567 A 5/1942 Barton
2,442,917 A 6/1948 Butterfield
2,451,271 A 10/1948 Balster
2,468,976 A 5/1949 Herreshoff
2,471,509 A 5/1949 Anderson
2,878,990 A 3/1950 Zurcher
2,644,433 A 7/1953 Anderson
2,761,516 A 9/1956 Vassilkovsky
2,766,839 A 10/1956 Baruch
2,898,894 A 8/1959 Holt
2,915,050 A 12/1959 Allred
2,956,738 A 10/1960 Rosenschold
2,977,943 A 4/1961 Lieberherr
2,979,046 A 4/1961 Hermann
3,033,184 A 5/1962 Jackson
3,035,879 A 5/1962 Jost
3,113,561 A 12/1963 Heintz
3,143,282 A 8/1964 McCrory
3,154,059 A 10/1964 Witzky
3,171,425 A 3/1965 Berlyn
3,275,057 A 9/1966 Trevor
3,399,008 A 8/1968 Farrell
3,409,410 A 11/1968 Spence
3,491,654 A 1/1970 Zurcher
3,534,771 A 10/1970 Everdam
3,621,821 A 11/1971 Jarnuszkiewicz
3,702,746 A * 11/1972 Parmerlee ..... F01C 1/063 417/481
3,749,318 A 7/1973 Cottell
3,881,459 A 5/1975 Gaetcke
3,892,070 A 7/1975 Bose
3,911,753 A 10/1975 Daub
3,973,532 A 8/1976 Litz
4,043,224 A 8/1977 Quick
4,046,028 A 9/1977 Vachris
4,077,429 A 3/1978 Kimball
4,127,332 A 11/1978 Thiruvengadam
4,128,388 A 12/1978 Freze
4,164,988 A 8/1979 Virva
4,182,282 A 1/1980 Pollet
4,185,597 A 1/1980 Cinquegrani
4,271,803 A 6/1981 Nakanishi
4,300,499 A 11/1981 Nakanishi
4,312,305 A 1/1982 Noguchi
4,324,214 A 4/1982 Garcea
4,331,118 A 5/1982 Cullinan
4,332,229 A 6/1982 Schuit
4,343,605 A 8/1982 Browning
4,357,916 A 11/1982 Noguchi
4,383,508 A 5/1983 Irimajiri
4,467,752 A 8/1984 Yunick
4,480,597 A 11/1984 Noguchi
4,488,866 A 12/1984 Schirmer
4,541,377 A 9/1985 Amos
4,554,893 A 11/1985 Vecellio
4,570,589 A 2/1986 Fletcher
4,576,126 A 3/1986 Ancheta
4,592,318 A 6/1986 Pouring
4,597,342 A 7/1986 Green
4,598,687 A 7/1986 Hayashi
4,669,431 A 6/1987 Simay
4,715,791 A 12/1987 Berlin
4,724,800 A 2/1988 Wood
4,756,674 A 7/1988 Miller
4,788,942 A 12/1988 Pouring
4,836,154 A 6/1989 Bergeron
4,874,310 A 10/1989 Seemann
4,879,974 A 11/1989 Alvers
4,919,611 A 4/1990 Flament
4,920,937 A 5/1990 Sasaki
4,936,269 A 6/1990 Beaty
4,969,425 A 11/1990 Slee
4,990,074 A 2/1991 Nakagawa
4,995,349 A 2/1991 Tuckey
5,004,066 A 4/1991 Furukawa
5,007,392 A 4/1991 Niizato
5,020,504 A 6/1991 Morikawa
5,083,539 A 1/1992 Cornelio
5,154,141 A 10/1992 McWhorter
5,168,843 A 12/1992 Franks
5,213,074 A 5/1993 Imagawa
5,222,879 A 6/1993 Kapadia
5,251,817 A 10/1993 Ursic
5,343,618 A 9/1994 Arnold
5,357,919 A 10/1994 Ma
5,390,634 A 2/1995 Walters
5,397,180 A 3/1995 Miller
5,398,645 A 3/1995 Haman
5,454,712 A 10/1995 Yap
5,464,331 A 11/1995 Sawyer
5,479,894 A 1/1996 Noltemeyer
5,694,891 A 12/1997 Liebich
5,714,721 A 2/1998 Gawronski
5,779,461 A 7/1998 Iizuka
5,791,303 A 8/1998 Skripov
5,872,339 A 2/1999 Hanson
5,937,821 A 8/1999 Oda
5,957,096 A 9/1999 Clarke
6,003,488 A 12/1999 Roth
6,019,188 A 2/2000 Nevill
6,119,648 A 9/2000 Araki
6,138,616 A 10/2000 Svensson
6,138,639 A 10/2000 Hiraya
6,199,369 B1 3/2001 Meyer
6,205,962 B1 3/2001 Berry, Jr.
6,237,164 B1 5/2001 LaFontaine
6,257,180 B1 7/2001 Klein
6,270,322 B1 * 8/2001 Hoyt ..... F01C 9/002 123/18 A
6,321,693 B1 * 11/2001 Kim ..... F01C 9/002 123/18 R
6,363,903 B1 4/2002 Hayashi
6,382,145 B2 5/2002 Matsuda
6,418,905 B1 7/2002 Baudlot
6,446,592 B1 9/2002 Wilksch
6,474,288 B1 11/2002 Blom
6,494,178 B1 12/2002 Cleary
6,508,210 B2 1/2003 Knowlton
6,508,226 B2 1/2003 Tanaka
6,536,420 B1 3/2003 Cheng
6,639,134 B2 10/2003 Schmidt
6,668,703 B2 12/2003 Gamble
6,682,313 B1 1/2004 Sulmone
6,691,932 B1 2/2004 Schultz
6,699,031 B2 3/2004 Kobayashi
6,705,281 B2 3/2004 Okamura
6,718,938 B2 4/2004 Szorenyi
6,758,170 B1 7/2004 Walden
6,769,390 B2 8/2004 Hattori
6,814,046 B1 11/2004 Hiraya
6,832,589 B2 12/2004 Kremer
6,834,626 B1 12/2004 Holmes
6,971,379 B2 12/2005 Sakai
6,973,908 B2 12/2005 Paro
7,074,992 B2 7/2006 Schmidt
7,150,609 B2 12/2006 Kiem
7,261,079 B2 8/2007 Gunji
7,296,545 B2 11/2007 Ellingsen, Jr.
7,341,040 B1 3/2008 Wiesen
7,360,531 B2 4/2008 Yohso
7,452,191 B2 11/2008 Tell
7,559,298 B2 7/2009 Cleeves
7,576,353 B2 8/2009 Diduck
7,584,820 B2 9/2009 Parker
7,628,606 B1 12/2009 Browning

(56) References Cited

U.S. PATENT DOCUMENTS

| | | | | |
|---|---|---|---|---|
| 7,634,980 | B2 | 12/2009 | Jarnland | |
| 7,717,701 | B2 | 5/2010 | D'Agostini | |
| 7,810,479 | B2 | 10/2010 | Naquin | |
| 7,827,901 | B2 * | 11/2010 | Kudarauskas | B60K 6/24 91/339 |
| 7,900,454 | B2 | 3/2011 | Schoell | |
| 7,984,684 | B2 | 7/2011 | Hinderks | |
| 8,037,862 | B1 | 10/2011 | Jacobs | |
| 8,215,292 | B2 | 7/2012 | Bryant | |
| 8,251,040 | B2 | 8/2012 | Jang | |
| 8,284,977 | B2 | 10/2012 | Ong | |
| 8,347,843 | B1 | 1/2013 | Batiz-Vergara | |
| 8,385,568 | B2 | 2/2013 | Goel | |
| 8,479,871 | B2 | 7/2013 | Stewart | |
| 8,640,669 | B2 | 2/2014 | Nakazawa | |
| 8,656,870 | B2 | 2/2014 | Sumilla | |
| 8,714,135 | B2 | 5/2014 | Anderson | |
| 8,776,759 | B2 | 7/2014 | Cruz | |
| 8,800,527 | B2 | 8/2014 | McAlister | |
| 8,827,176 | B2 | 9/2014 | Browning | |
| 8,857,405 | B2 | 10/2014 | Attard | |
| 8,863,724 | B2 | 10/2014 | Shkolnik | |
| 8,919,321 | B2 | 12/2014 | Burgess | |
| 9,175,736 | B2 | 11/2015 | Greuel | |
| 9,289,874 | B1 | 3/2016 | Sabo | |
| 9,309,807 | B2 | 4/2016 | Burton | |
| 9,441,573 | B1 | 9/2016 | Sergin | |
| 9,512,779 | B2 | 12/2016 | Redon | |
| 9,736,585 | B2 | 8/2017 | Pattok | |
| 9,739,382 | B2 | 8/2017 | Laird | |
| 9,822,968 | B2 | 11/2017 | Tamura | |
| 9,854,353 | B2 | 12/2017 | Wang | |
| 9,938,927 | B2 | 4/2018 | Ando | |
| 2002/0114484 | A1 | 8/2002 | Crisco | |
| 2002/0140101 | A1 | 10/2002 | Yang | |
| 2003/0111122 | A1 | 6/2003 | Horton | |
| 2005/0036896 | A1 | 2/2005 | Navarro | |
| 2005/0087166 | A1 | 4/2005 | Rein | |
| 2005/0155645 | A1 | 7/2005 | Freudendahl | |
| 2005/0257837 | A1 | 11/2005 | Bailey | |
| 2006/0230764 | A1 | 10/2006 | Schmotolocha | |
| 2007/0039584 | A1 | 2/2007 | Ellingsen, Jr. | |
| 2007/0101967 | A1 | 5/2007 | Pegg | |
| 2008/0169150 | A1 | 7/2008 | Kuo | |
| 2008/0184878 | A1 | 8/2008 | Chen | |
| 2008/0185062 | A1 | 8/2008 | Johannes Nijland | |
| 2010/0071640 | A1 | 3/2010 | Mustafa | |
| 2011/0030646 | A1 | 2/2011 | Barry | |
| 2011/0132309 | A1 | 6/2011 | Turner | |
| 2011/0139114 | A1 | 6/2011 | Nakazawa | |
| 2011/0235845 | A1 | 9/2011 | Wang | |
| 2012/0103302 | A1 | 5/2012 | Attard | |
| 2012/0114148 | A1 | 5/2012 | Goh Kong San | |
| 2012/0186561 | A1 | 7/2012 | Bethel | |
| 2013/0036999 | A1 | 2/2013 | Levy | |
| 2013/0327039 | A1 | 12/2013 | Schenker et al. | |
| 2014/0056747 | A1 * | 2/2014 | Kim | F04C 2/077 418/205 |
| 2014/0109864 | A1 | 4/2014 | Drachko | |
| 2014/0199837 | A1 | 7/2014 | Hung | |
| 2014/0361375 | A1 | 12/2014 | Deniz | |
| 2015/0059718 | A1 | 3/2015 | Claywell | |
| 2015/0153040 | A1 | 6/2015 | Rivera Garza | |
| 2015/0167536 | A1 | 6/2015 | Toda et al. | |
| 2015/0184612 | A1 | 7/2015 | Takada et al. | |
| 2015/0337878 | A1 | 11/2015 | Schlosser | |
| 2015/0354570 | A1 | 12/2015 | Karoliussen | |
| 2016/0017839 | A1 | 1/2016 | Johnson | |
| 2016/0064518 | A1 | 3/2016 | Liu | |
| 2016/0258347 | A1 | 9/2016 | Riley | |
| 2016/0265416 | A1 | 9/2016 | Ge | |
| 2016/0348611 | A1 | 12/2016 | Suda et al. | |
| 2016/0348659 | A1 | 12/2016 | Pinkerton | |
| 2016/0356216 | A1 | 12/2016 | Klyza | |
| 2017/0248099 | A1 | 8/2017 | Wagner | |
| 2017/0260725 | A1 | 9/2017 | McAlpine | |
| 2018/0096934 | A1 | 4/2018 | Siew | |
| 2018/0130704 | A1 | 5/2018 | Li | |

FOREIGN PATENT DOCUMENTS

| | | | | |
|---|---|---|---|---|
| CN | 206131961 | | 4/2017 | |
| DE | 19724225 | | 12/1998 | |
| EP | 0025831 | | 4/1981 | |
| EP | 2574796 | | 4/2013 | |
| FR | 944904 | A * | 4/1949 | F04C 2/077 |
| FR | 1408306 | | 8/1965 | |
| FR | 2714473 | | 6/1995 | |
| GB | 104331 | | 1/1918 | |
| GB | 139271 | | 3/1920 | |
| GB | 475179 | | 11/1937 | |
| GB | 854135 | | 11/1960 | |
| GB | 1437340 | | 5/1976 | |
| GB | 1504279 | | 3/1978 | |
| GB | 1511538 | | 5/1978 | |
| GB | 2140870 | | 12/1984 | |
| JP | S5377346 | | 7/1978 | |
| JP | S5833393 | | 2/1983 | |
| JP | 58170840 | | 10/1983 | |
| JP | S5973618 | | 4/1984 | |
| JP | H02211357 | | 8/1990 | |
| JP | H0638288 | | 5/1994 | |
| JP | 2000064905 | | 3/2000 | |
| JP | 2003065013 | | 3/2003 | |
| JP | 5535695 | | 7/2014 | |
| TW | 201221753 | | 6/2012 | |
| WO | 1983001485 | | 4/1983 | |
| WO | 2006046027 | | 5/2006 | |
| WO | 2007065976 | | 6/2007 | |
| WO | 2010118518 | | 10/2010 | |
| WO | 2016145247 | | 9/2016 | |

OTHER PUBLICATIONS

Graunke, K. et al., "Dynamic Behavior of Labyrinth Seals in Oilfree Labyrinth-Piston Compressors" (1984). International Compressor Engineering Conference. Paper 425. http://docs.lib.purdue.edu/icec/425.

International Searching Authority Search Report and Written Opinion for application PCT/US2018/024102, dated Jun. 25, 2018, 10 pages.

International Searching Authority Search Report and Written Opinion for application PCT/US2018/024477, dated Jul. 20, 2018, 14 pages.

International Searching Authority Search Report and Written Opinion for application PCT/US2018/024485, dated Jun. 25, 2018, 16 pages.

International Searching Authority Search Report and Written Opinion for application PCT/US2018/024844, dated Jun. 8, 2018, 9 pages.

International Searching Authority Search Report and Written Opinion for application PCT/US2018/024852, dated Jun. 21, 2018, 9 pages.

International Searching Authority Search Report and Written Opinion for application PCT/US2018/025133, dated Jun. 28, 2018, 9 pages.

International Searching Authority Search Report and Written Opinion for application PCT/US2018/025151, dated Jun. 25, 2018, 14 pages.

International Searching Authority Search Report and Written Opinion for application PCT/US2018/025471, dated Jun. 21, 2018, 10 pages.

International Searching Authority Search Report and Written Opinion for application PCT/US2018/029947, dated Jul. 26, 2018, 12 pages.

International Searching Authority Search Report and Written Opinion for application PCT/US2018/030937, dated Jul. 9, 2018, 7 pages.

(56) References Cited

OTHER PUBLICATIONS

International Searching Authority Search Report and Written Opinion for application PCT/US2018/053264, dated Dec. 3, 2018, 10 pages.
International Searching Authority Search Report and Written Opinion for application PCT/US2018/053350, dated Dec. 4, 2018, 7 pages.
International Searching Authority Search Report and Written Opinion for application PCT/US2019/014936, dated Apr. 18, 2019, 9 pages.
International Searching Authority Search Report and Written Opinion for application PCT/US2019/015189, dated Mar. 25, 2019, 10 pages.
Keller, L. E., "Application of Trunk Piston Labyrinth Compressors in Refrigeration and Heat Pump Cycles" (1992). International Compressor Engineering Conference. Paper 859. http://docs.lib.purdue.edu/icec/859.
Quasiturbine Agence, "Theory—Quasiturbine Concept" [online], Mar. 5, 2005 (Mar. 5, 2005), retrieved from the internet on Jun. 29, 2018) URL:http://quasiturbine.promci.qc.ca/ETheoryQTConcept.htm; entire document.
Vetter, H., "The Sulzer Oil-Free Labyrinth Piston Compressor" (1972). International Compressor Engineering Conference. Paper 33. http://docs.lib.purdue.edu/icec/33.

* cited by examiner

VARIABLE VOLUME CHAMBER FOR INTERACTION WITH A FLUID

CROSS REFERENCE TO RELATED APPLICATIONS

This application relates to and claims the priority of U.S. provisional patent application Ser. No. 62/501,318, which was filed May 4, 2017; and U.S. patent application Ser. No. 15/965,009 which was filed Apr. 27, 2018.

FIELD OF THE INVENTION

The present invention relates generally to variable volume chamber devices which act on fluids.

BACKGROUND OF THE INVENTION

A Variable Volume Chamber Device ("VVCD") may be used to act on a fluid, such as in a pump or compressor. Many fluid pumps and compressors use cooperative cylinder and piston arrangements that define a variable volume chamber to act on a gas or a liquid. In pumps and compressors, the motion of a piston may draw a gas or liquid into a variable volume chamber, and expel the gas or liquid to a downstream location or a compressor reservoir.

Variable volume chamber devices that use pistons are less efficient than desired, at least in part, due to the nature of the variable volume chamber used therein. It would be beneficial to decrease or eliminate these inefficiencies. For example, the pistons in piston type pumps and compressors must constantly accelerate, travel, deaccelerate, stop, and reverse their motion in the region of bottom dead center and top dead center positions to create a variable volume chamber. While this constantly reversing pumping motion of the piston produces a variable volume chamber formed between the piston head and the surrounding cylinder, it eliminates conservation of momentum, thereby reducing efficiency. Accordingly, there is a need for variable volume chamber devices that preserve at least some of the momentum built up through repeated compressive and expansive motions.

Fluid pumps and compressors may be used to act on gasses and liquids for a myriad of different purposes, including without limitation to boost the pressure of intake air supplied for combustion in an internal combustion engine. Boosting the pressure of air in internal combustion engines may benefit efficiency in many respects. Superchargers provide one means for boosting air pressures, however, they add cost and weight, take up space, and require maintenance. Accordingly, there is a need for superchargers that are superior to existing superchargers in terms of cost, weight, space utilization, and maintenance requirements.

OBJECTS OF THE INVENTION

Accordingly, it is an object of some, but not necessarily all embodiments of the present invention to provide variable volume chamber devices that preserve at least some of the momentum of the moving parts built up through repeated compressive and expansive events. The use of oscillating relative motion rotors to define variable volume chambers may permit built up momentum to be preserved.

It is also an object of some, but not necessarily all embodiments of the present invention to provide improved internal combustion engine supercharger designs. Embodiments of the invention may use oscillating relative motion rotors to define variable volume chambers to provide superchargers that are superior in terms of cost, weight, performance, maintenance and/or complexity.

It is also an object of some, but not necessarily all embodiments of the present invention to provide variable volume chambers that may be used for non-power generating applications, such as for pumps and compressors. To this end, embodiments of the invention may use oscillating relative motion rotors to define one or more variable volume chambers that may act independently or in concert to pump or pressurize fluids.

These and other advantages of some, but not necessarily all, embodiments of the present invention will be apparent to those of ordinary skill in the art.

SUMMARY OF THE INVENTION

Responsive to the foregoing challenges, Applicant has developed an innovative variable volume chamber device comprising: a first axial member; a first rotor mounted on the first axial member, said first rotor having: a generally cylindrical peripheral wall spaced from the first axial member; a first fluid port extending through the peripheral wall; a central opening surrounding the first axial member; a front wall extending away from the first axial member to the peripheral wall, said front wall defining a boundary for the central opening; a second fluid port extending through the front wall in the proximity of the central opening; a first rotor fin extending from the central opening along the front wall to the peripheral wall; a second axial member that is co-axial with the first axial member; a second rotor mounted on the second axial member and disposed at least in part within the first rotor peripheral wall, said second rotor having: a rear wall extending away from the second axial member to the peripheral wall, a central hub extending away from the rear wall and disposed within the first rotor central opening; a second rotor fin extending from the central hub along the rear wall to a location proximal to the peripheral wall; two fluid passages extending through the central hub; a first variable-speed driver connected to the first rotor; and a second variable-speed driver connected to the second rotor.

Applicant has further developed an innovative variable volume chamber device, comprising: a first rotor; a second rotor disposed adjacent to the first rotor, wherein the first rotor and the second rotor are configured to rotate independently relative to each other; a plurality of variable volume chambers formed in between the first rotor and the second rotor; a fluid inlet communicating with each of the plurality of variable volume chambers; a fluid outlet communicating with each of the plurality of variable volume chambers; a first variable-speed driver connected to the first rotor; and a second variable-speed driver connected to the second rotor, wherein a volume of each of the plurality of variable volume chambers varies in response to the variation of relative rotational speeds of the first variable-speed driver and the second variable-speed driver.

Applicant has still further developed an innovative variable volume chamber device, comprising: a first variable-speed driver; a second variable-speed driver; a plurality of variable volume chambers formed by cooperating first and second structures; a fluid inlet communicating with each of the plurality of variable volume chambers; and a fluid outlet communicating with each of the plurality of variable volume chambers, wherein the first variable-speed driver is connected to the first structure and configured to rotate the first structure, wherein the second variable-speed driver is connected to the second structure and configured to rotate the second structure, and wherein a volume of each of the plurality of variable volume chambers varies in response to the variation of relative rotational speeds of the first variable-speed driver and the second variable-speed driver.

Applicant has still further developed an innovative method of pumping or compressing a fluid, comprising the steps of: providing a fluid to a variable volume chamber defined at least in part by a first wall and a second wall, wherein the first wall and second wall are configured to rotate independently of each other about a common axis; rotating the first wall at a variable first angular rate during a period of time; rotating the second wall at a variable second angular rate during the period of time; and changing the variable volume of the chamber so as to push the fluid through a variable volume chamber outlet by changing the variable first angular rate relative to the variable second angular rate during the period of time.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF EMBODIMENTS OF THE INVENTION

Figure 1:
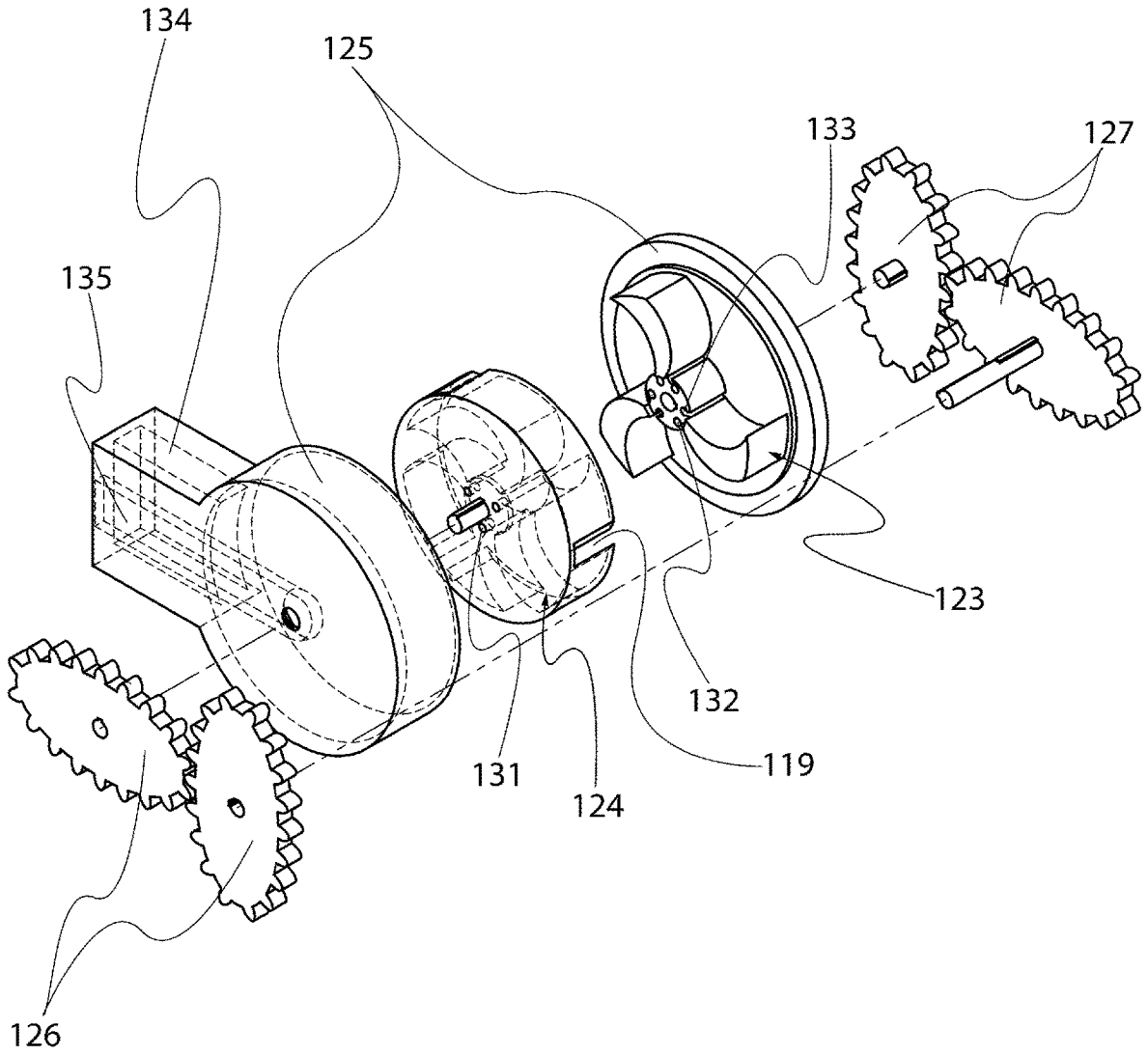
FIG. 1 is an exploded view of an example embodiment of a VVCD.

Reference will now be made in detail to embodiments of the present invention, examples of which are illustrated in the accompanying drawings. With reference to FIG. 1, a first example embodiment of an oscillating relative motion rotor VVCD is illustrated. The VVCD may include an intake-exhaust manifold and cover 125, a front rotor 124, and a rear rotor 123. The front rotor 124 may be locked to a first axial member by a first shaft key, and the rear rotor 123 may be locked to a second axial member by a second shaft key. The first axial member and the second axial member may be co-axial and preferably nested one within the other to facilitate alignment of the two members. The front rotor 124 and the rear rotor 123 may rotate independently of each other. The manifold and cover 125 may incorporate a fluid inlet pocket and passage 134 and an exhaust passage 135. The cover 125 may surround the front rotor 124 and rear rotor 123. The front rotor 124 and the rear rotor 123 may include interior walls which collectively define a plurality of variable volume chambers.

Specifically, the front rotor 124 may include a front wall extending from the first axial member to an outer generally cylindrical wall. The portion of the front wall nearest the first axial member may form a front boundary for a central opening surrounding the first axial member. Fluid outlet passages 131 may extend through the front wall of the front rotor 124 in the proximity of the central opening. The fluid outlet passages 131 may lead to the exhaust passage 135 in the intake-exhaust manifold and cover 125. The exhaust passage 135 may lead to the ambient environment, to a compressor reservoir, a pump passage, or some other location. A set of three front rotor 124 fins, spaced apart 120 degrees center-to-center, may project out from the front wall of the front rotor in the direction parallel with the center axis of the first axial member. The front rotor 124 fins may extend from locations proximal to the first axial member outward like spokes on a wheel to the outer generally cylindrical wall. The front rotor 124 fins may have a varied thickness along their length and may be curved. Three fluid intake slits 119 may be provided around the outer generally cylindrical wall of the front rotor 124 at equal distances from each other and between each pair of front rotor fins.

The rear rotor 123 may include a rear wall extending from the second axial member to an outer periphery. A set of three rear rotor 123 fins, spaced apart 120 degrees center-to-center, may project out from the rear wall in the direction parallel with the center axis of the second axial member. The rear rotor 123 fins may extend from a central hub to a location proximal to the generally cylindrical wall of the front rotor 124. The rear rotor 123 fins may have a varied thickness along their length and may be curved to compliment and mate intimately with the front rotor 124 fins. The front rotor fins and the rear rotor fins may project towards each other and each group of three fins may nest with the other group of three fins. A pair of two fluid output slits 132 and 133 may extend through the center hub of the rear rotor 123 between each neighboring pair of rear rotor 123 fins. Each of the slits and passages 132 and 133 in a pairing may alternate registering with a single corresponding fluid outlet passage 131 in the front rotor 124 when alternate groups of chambers are near minimum volume.

When assembled together, the front rotor 124 and the rear rotor 123 may operate cooperatively as follows. The fluid intake slits 119 allow fluid to enter the front rotor 124 from the fluid inlet pocket and passage 134 within the intake-exhaust manifold and cover 125. The fluid, such as air, may be drawn from the ambient environment. The fluid may enter into the portion of the area between two neighboring front rotor 124 fins that is not blocked off by the rear rotor 123 fin nested between the neighboring front rotor fins. The rear rotor 123 fins divide the three chambers defined by the front rotor 124 fins into three groups of mating chambers, for a total of six chambers. The rear rotor 123 fins, being of a preselected thickness at their outer edge, may selectively block the fluid intake slits 119 in the front rotor 124 when the rear rotor fins are at a center position in each of the three groups of mating chambers, but reveal the intake slits 119 to a first group of three chambers when the other group of three chambers is at a minimum volume, and vice-versa.

The relative motion oscillating VVCD may be driven using interconnected first and second sets of non-circular or bi-lobe gears 126 and 127 (i.e., one type of variable-speed drivers). In this embodiment, the non-circular gears may be elliptical or oval gears. The first shaft key may lock the first set of gears 126 to the first axial member, and the second shaft key may lock the second set of gears 127 to the second axial member. A third axial member may extend between the first and second sets of gears 126 and 127 and may lock the two gear sets together to synchronize their rotations. The two VVCD components (i.e., the front rotor 124 and the rear rotor 123) may be geared at a 90-degree offset and the fins on the opposing rotors may located at a 60-degree displacement from each other. Accordingly, the VVCD first and second shaft keys for the front rotor 124 and the rear rotor 123 may have a starting 30-degree offset from one-another. The first and second sets of gears 126 and 127 may provide two alternating speeds in four areas and four areas of speed transition per input shaft rotation. The external relative motion oscillating VVCD could also be driven by other drivers, such as an electronically controlled motion system, an oscillating mechanism, or by other gear types such as multi-lobe constant speed gearing, nautilus gears, or other gears which would allow the appropriate motion of the mechanism.

Figure 2:
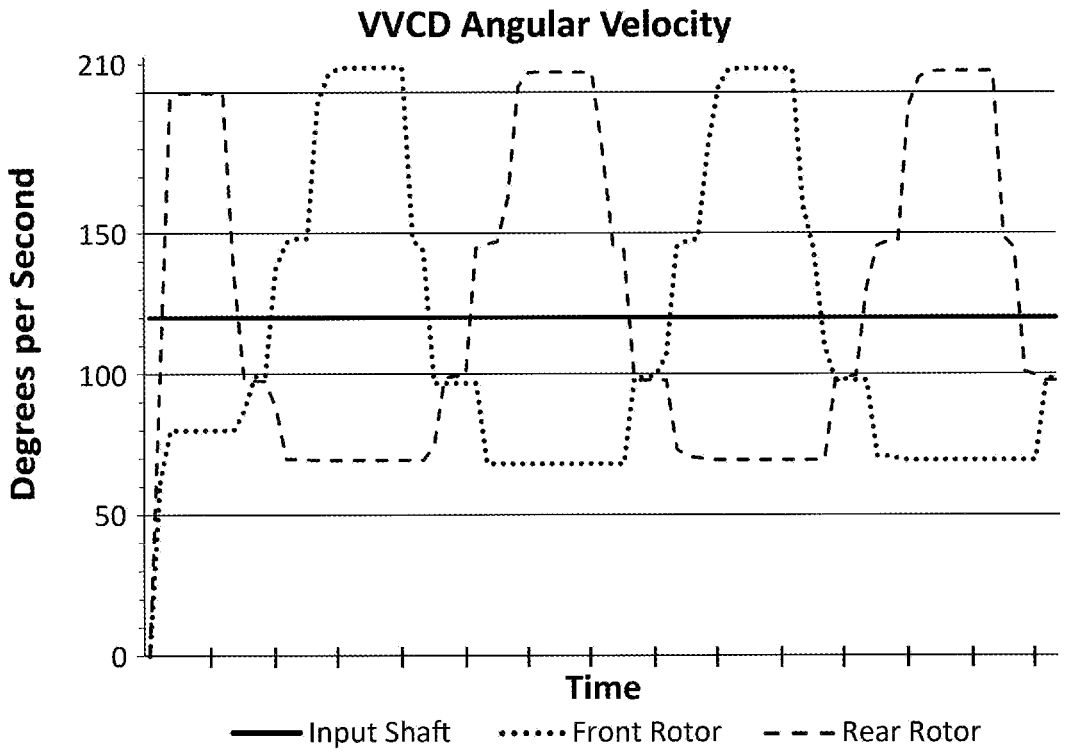
FIG. 2 is a prophetic graph of rotor angular position and clearance for the VVCD shown in FIG. 1.
Figure 3:
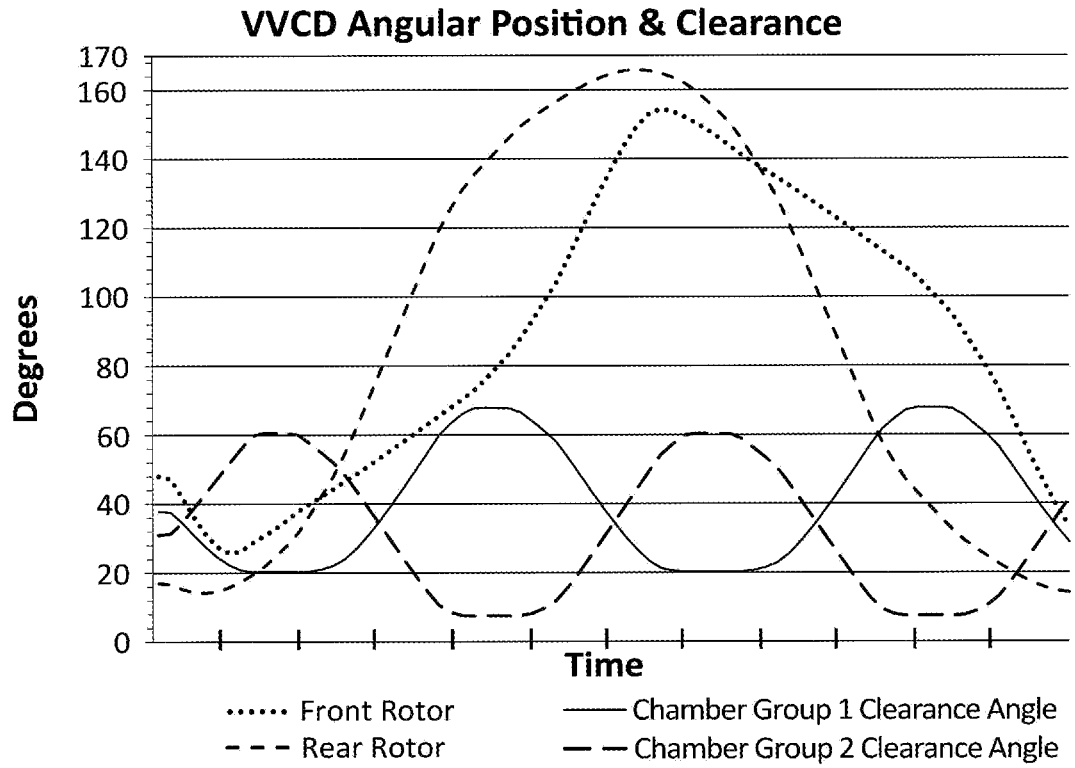
FIG. 3 is a prophetic graph of rotor angular velocity for the VVCD shown in FIG. 1.

With reference to FIGS. 1, 2 and 4A-4C, the relative motion oscillating VVCD may create a relative motion of the front rotor 124 fins and the rear rotor 123 fins by accelerating and decelerating each rotor between the two speeds provided by the gearing at alternating times. Every time the two rotor angular velocity lines intersect as shown in FIG. 2, a first group of three of the six chambers output fluid at the chamber minimum clearance angle as seen in FIG. 3. The minimum clearance angles shown in FIG. 3 translate to clearance distances of nearly zero between the front rotor 124 and rear rotor 123 fins due to the curved design of the fins themselves, which also accounts for the first group of chambers appearing to have larger minimum angular clearances than the other group. In the simulation described by FIGS. 2 and 3, the working fluid was air and the input shaft was driven at 120-degrees-per-second, which would drive the VVCD components at two speeds with the speed scaling factor being approximately 1.7 above and below the input speed. One input drive shaft rotation may generate four compressed air output cycles from the groups with the chambers alternating every other from the six half chambers of the VVCD.

The output at the intersection of the front and rear rotor velocity lines is due to the chasing movement created where the front rotor 124 chases and catches the rear rotor 123, then the rear rotor 123 chases and catches the front rotor 124. During each chasing motion, fluid may pass through the fluid intake slits 119 into the space between the front rotor and the rear rotor 123, and thereafter be acted upon by the rotors. This may create a pseudo or relative motion oscillation without having the one rotor start, stop, reverse, and stop constantly while the other rotor remains stationary. This may allow the VVCD to conserve some momentum and increase the fluid output when compared with a piston compressor. Like a piston compressor, the fluid output pulsing can be smoothed by using multiple chambers keyed at differing offset angles from the gear train to allow common gearing at a reduced cost but to create a more consistent and/or larger output volume and pressure.

Figure 4A:
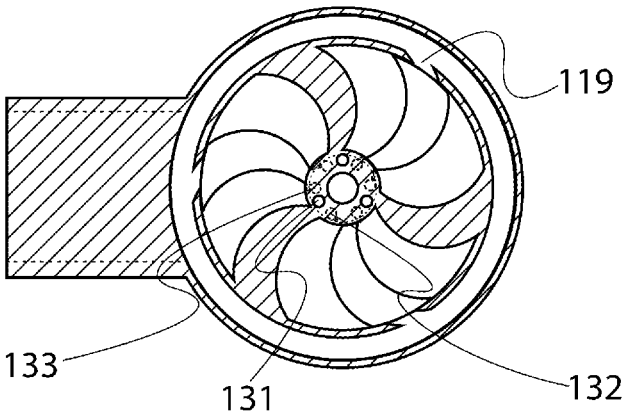
FIGS. 4A-4C are cross-sectional plan views of rotors in the VVCD shown in FIG. 1 at different points of relative rotation.

With reference to FIG. 4A, the rear rotor fins are blocking the front rotor fluid intake slits 119 provided around the periphery of the rotor. A first group of three chambers is below atmospheric pressure if the design is equipped with one-way valves (not shown) on the outlet passages 131 or nearer to atmospheric pressure if it is not so equipped. The second group of three chambers is at or slightly above atmospheric pressure. During this time period, the front rotor is moving slowly and the rear rotor is moving briskly in comparison. As the drive shaft rotates counter-clockwise, the front rotor fins rotate clockwise. This causes three of the chambers to intake fluid while the other three chambers simultaneously act on the fluid in them.

Figure 4B:
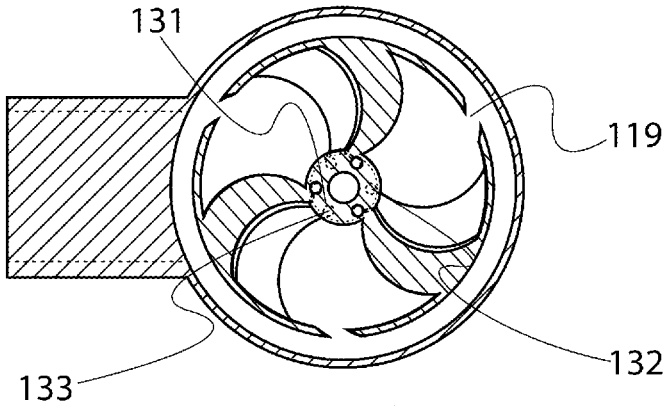

With reference to FIG. 4B, the front rotor begins to accelerate as the rear rotor completes deceleration. Fluid has entered the fluid intake slit 119 and filled the space between the rotors that is in communication with the fluid intake slits. During this time period, one of the fluid passages 132 and 133 leading to the chambers in the rear rotor may register with the fluid outlets 131 in the front rotor, causing the fluid between the rotors to push through the fluid outlets and through optional one-way valves (not shown). The fluid exiting the chambers may be added to the fluid in the exhaust passage in the intake-exhaust manifold and cover.

Figure 4C:
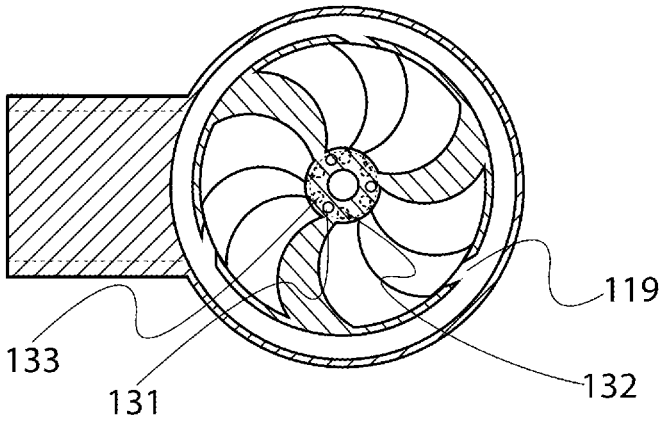

With reference to FIG. 4C, the rear rotor 123 fins have rotated clockwise, blocking the front rotor 124 fluid intake slits 119. This begins the compression or pump cycle for the second group of three chambers and leads to a fluid intake cycle for the first group of three chambers. During this time period, the front rotor moves briskly and the rear rotor moves slowly in comparison. One of the fluid passages 132 and 133 leading to the chambers in the rear rotor 123 may register with the fluid outlets 131 in the front rotor 124 as the drive shaft rotates. This leads to a new pumping or compression cycle. This process may repeat so that alternating groups of three chambers cycle through fluid filling and fluid pumping or compression processes.

Figure 5:
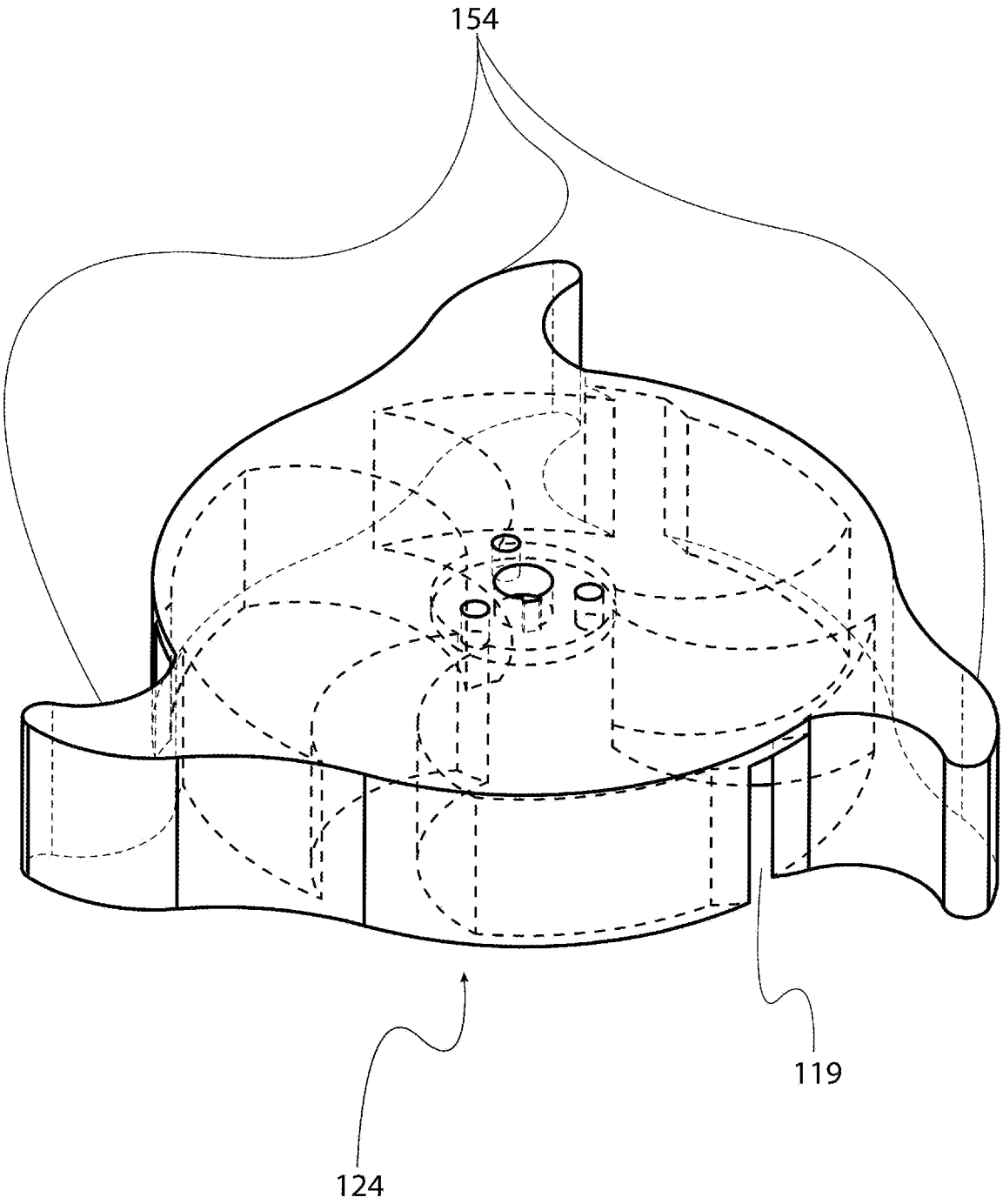
FIG. 5 is a pictorial view of an alternative embodiment VVCD front rotor including a phantom illustration of internal chambers.

With reference to FIGS. 1 and 5, it may also be advantageous to shape the outside of the front rotor 124 with fluid directing ridges 154 adjacent to the fluid intake slits 119 to form a fan/pump/compressor between the intake-exhaust manifold and cover and the front rotor 124. It may also be advantageous to employ one-way valves (not shown) on the intake slits 119 and on the fluid outlet passages 131 to increase the volume and pressure that the compressor can produce by allowing the chambers to intake for a longer period. These one-way valves may also be employed per group of three chambers for reduced cost if the intake slit 119 number is increased from three to six with each intake slit being located at an offset distance from its original central location giving each chamber a separate intake slit (not shown).

As will be understood by those skilled in the art, the invention may be embodied in other specific forms without departing from the spirit or essential characteristics thereof. The elements described above are illustrative examples of one technique for implementing the invention. One skilled in the art will recognize that many other implementations are possible without departing from the intended scope of the present invention as recited in the claims. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. A method of pumping or compressing a fluid, comprising the steps of:

providing a fluid to a variable volume chamber defined at least in part by a first wall and a second wall and a central opening, wherein the first wall and second wall are configured to rotate independently of each other about a common axis;

rotating the first wall at a variable first angular rate during a period of time;

rotating the second wall at a variable second angular rate during the period of time; and changing the variable volume of the chamber so as to push the fluid through a variable volume chamber outlet by changing the variable first angular rate relative to the variable second angular rate during the period of time, said variable volume chamber outlet being located adjacent to the central opening.

2. A variable volume chamber device, comprising:

a first driver;

a second driver;

a plurality of variable volume chambers formed between a front wall and a rear wall and formed around a central opening;

a fluid inlet communicating with each of the plurality of variable volume chambers; and a fluid outlet communicating with each of the plurality of variable volume chambers, said fluid outlet located adjacent to the central opening, wherein the first driver is connected to the front wall and configured to rotate the front wall, wherein the second driver is connected to the rear wall and configured to rotate the rear wall, and wherein a volume of each of the plurality of variable volume chambers varies in response to the variation of relative rotational speeds of the first driver and the second driver.

3. A variable volume chamber device, comprising:

a first rotor having a central opening;

a second rotor disposed adjacent to the first rotor, wherein the first rotor and the second rotor are configured to rotate independently relative to each other;

a plurality of variable volume chambers formed in between the first rotor and the second rotor;

a fluid inlet communicating with each of the plurality of variable volume chambers;

a fluid outlet communicating with each of the plurality of variable volume chambers, said fluid outlet located adjacent to the central opening;

a first driver connected to the first rotor; and a second driver connected to the second rotor, wherein a volume of each of the plurality of variable volume chambers varies in response to the variation of relative rotational speeds of the first driver and the second driver.

4. A variable volume chamber device comprising:

a first rotor having:

a central opening;

a generally cylindrical peripheral wall spaced from the central opening;

a first fluid port extending through the peripheral wall;

a front wall extending away from the central opening to the peripheral wall, said front wall defining a boundary for the central opening;

a second fluid port extending through the front wall;

a first rotor fin extending from the central opening along the front wall to the peripheral wall;

a second rotor disposed at least in part within the first rotor peripheral wall, said second rotor having:

a central hub;

a rear wall extending away from the central hub towards the peripheral wall, said central hub extending away from the rear wall and disposed within the first rotor central opening;

a second rotor fin extending from the central hub along the rear wall to a location proximal to the peripheral wall;

at least two fluid passages extending through the central hub;

a first driver connected to the first rotor; and a second driver connected to the second rotor.

5. The variable volume chamber device of claim 4, further comprising:

a cover surrounding the first rotor, said cover having a fluid intake opening and a fluid exhaust opening.

6. The variable volume chamber device of claim 4, wherein the first rotor is configured to rotate at a variable first rotor rate, wherein the second rotor is configured to rotate at a variable second rotor rate, wherein the variable first rotor rate is greater than the variable second rotor rate during a first portion of a 360-degree rotation of the first rotor, and wherein the variable first rotor rate is less than the variable second rotor rate during a second portion of the 360-degree rotation of the first rotor.

7. The variable volume chamber device of claim 6, wherein each of the two fluid passages selectively register with the second fluid port as a result of variation of the variable first rotor rate, variation of the variable second rotor rate, or variation of both the variable first rotor rate and the variable second rotor rate.

8. The variable volume chamber device of claim 6, wherein a driver selected from the group consisting of the first driver and the second driver, includes enmeshed non-circular gears.

9. The variable volume chamber device of claim 6, wherein the first driver and the second driver each include enmeshed non-circular gears.

10. The variable volume chamber device of claim 4, comprising:

a plurality of said first rotor fins extending from the central opening along the front wall to the peripheral wall, said first rotor fins being equally spaced and angularly offset from each other; and a plurality of said second rotor fins extending from the central hub along the rear wall to a location proximal to the peripheral wall, said second rotor fins being equally spaced and angularly offset from each other, wherein the plurality of first rotor fins are interleaved with the plurality of second rotor fins to form a plurality of different neighboring rotor fin pairs each including one of the plurality of first rotor fins paired with one of the plurality of second rotor fins.

11. The variable volume chamber device of claim 10, wherein each of the plurality of different neighboring rotor fin pairs includes one of the plurality of first rotor fins and one of the plurality of second rotor fins having complementary inverse mating surfaces that form a variable volume chamber between the front wall and the rear wall.

12. The variable volume chamber device of claim 11, wherein each of the plurality of first rotor fins has a greater thickness at a location proximal to the peripheral wall as compared with a location proximal to the central opening.

13. The variable volume chamber device of claim 12, wherein each of the plurality of second rotor fins has a greater thickness at a location proximal to the peripheral wall as compared with a location proximal the central hub.

14. The variable volume chamber device of claim 12, wherein each of the plurality of second rotor fins curves as it extends from the central hub along the rear wall to a location proximal to the peripheral wall.

15. The variable volume chamber device of claim 14, further comprising;

a cover surrounding the first rotor, said cover having a fluid intake opening and a fluid exhaust opening.

16. The variable volume chamber device of claim 15, wherein the first driver is configured to rotate the first rotor at a variable first rotor rate, wherein the second driver is configured to rotate the second rotor at a variable second rotor rate, wherein the variable first rotor rate is greater than the variable second rotor rate during a first portion of a 360-degree rotation of the first rotor, and wherein the variable first rotor rate is less than the variable second rotor rate during a second portion of the 360-degree rotation of the first rotor.

17. The variable volume chamber device of claim 16, wherein each of the two fluid passages selectively register with the second fluid port as a result of variation of the variable first rotor rate, variation of the variable second rotor rate, or variation of both the variable first rotor rate and the variable second rotor rate.

18. The variable volume chamber device of claim 17, wherein the first driver and the second driver each include enmeshed non-circular gears.

19. The variable volume chamber device of claim 18, comprising:

a first fluid port extending through the peripheral wall between each adjacent pair of the plurality of first rotor fins; and a second fluid port extending through the front wall for each adjacent pair of the plurality of first rotor fins.

20. The variable volume chamber device of claim 19, wherein there are at least two of the fluid passages extending through the central hub for each adjacent pair of the plurality of second rotor fins.

21. The variable volume chamber device of claim 11, wherein each of the plurality of first rotor fins curves as it extends from the central opening along the front wall to the peripheral wall.

* * * * *